US005969304A

United States Patent [19]

Barker et al.

[11] Patent Number: 5,969,304

[45] Date of Patent: Oct. 19, 1999

[54] ELEVATOR SYSTEM HAVING HIGH RISE ELEVATOR WITHOUT EXPRESS ZONE

[75] Inventors: Frederick H. Barker, Bristol; Bruce A. Powell, Canton; Joseph Bittar, Avon, all of Conn.

[73] Assignee: Otis Elevator Company, Farmington, Conn.

[21] Appl. No.: 09/176,586

[22] Filed: Oct. 21, 1998

[51] Int. Cl.[6] ..... B66B 1/18

[52] U.S. Cl. ..... 187/383; 187/395

[58] Field of Search ..... 187/380, 381, 187/382, 383, 385, 395, 249

[56] References Cited

U.S. PATENT DOCUMENTS 2,862,576 12/1958 Nikazy et al. ..... 187/384
5,460,245 10/1995 Bittar ..... 187/383

FOREIGN PATENT DOCUMENTS 4-80184 3/1992 Japan ..... 187/384

*Primary Examiner*—Robert E. Nappi

[57] ABSTRACT

An elevator system comprises a plurality of low rise elevators providing service between a lobby floor and the highest floor of a low rise in the building, high rise elevators providing express service between a lobby floor and the lowest floor of a high rise in the building as well as providing service to floors between the lowest floor of the high rise and the highest floor of the high rise, and a plurality of high-only elevators which provide service only to floors between the lowest floor of the high rise and the highest floor of the high rise, having no express zone to extend service downward to the lobby. Hall calls are entered as up calls, down calls, or lobby calls distinct from the down calls. The lobby calls are assigned only to the high rise elevators having express zones to provide service to the lobby. Up calls and down calls (not to the lobby) may be preferentially assigned to the high-only elevators.

6 Claims, 2 Drawing Sheets

ELEVATOR SYSTEM HAVING HIGH RISE ELEVATOR WITHOUT EXPRESS ZONE

TECHNICAL FIELD

This invention relates to elevator systems in which one or more high rise elevators serve only the high rise floors, with no express zone extending the service downward to a lobby.

BACKGROUND ART

The capacity of an elevator system, which is defined during the design phase of creating a new building, must serve the elevator traffic in the building in dependence upon the nature of expected building usage. Things that can result in adequate service with fewer elevator shafts include the manner of handling up-peak rush traffic, and the manner of handling down-peak rush traffic, along with the expected level of interfloor traffic (neither primarily up nor down and primarily not involving a lobby). Buildings which intend to serve multi-floor tenants, particularly high-density multi-floor tenants, are expected to have a high degree of interfloor traffic. In larger buildings, significant interfloor traffic may occur contemporaneously with the up-peak rush traffic from the lobby, the down-peak rush traffic to the lobby, as well as the noon traffic lobby down-peak and up-peak.

In extremely tall buildings (for instance, over 80 stories), significant interfloor traffic at the high end of the building may be served by a substantially complete elevator system, which provides no service at all below a certain floor. Access to and from the ground levels (e.g., the lobby) is by means of totally separate shuttle elevators, the upper end of which is designated as a lobby floor, referred to sometimes as a "sky lobby". However, the use of a sky lobby is inconsistent with smooth flowing traffic, and is found to be objectionable by passengers in other than the very tallest buildings.

In many instances, when the best dispatching techniques are employed, with elegant up-peak rush dispatching modes and elegant down-peak rush dispatching modes, there nonetheless arises a situation in which there is significant interfloor traffic in the highest end of the building, which alone results in the need for additional high rise elevators. Typically, high rise elevators only serve a group of contiguous upper floors, with a non-service express zone reaching to the ground levels.

DISCLOSURE OF INVENTION

Objects of the invention include satisfying the need for interfloor traffic at the high end of a building; reducing the amount of building space which must be dedicated to elevator hoistways; providing improved high-end elevator service in a building without the need of sky lobbies; reducing the size, speed and/or number of elevators required to provide a given level of service; and improved allocation of elevator hall calls in the down direction.

In accordance with the invention, dispatching is controlled either by destination call buttons, automatic destination call placement (such as with user-worn radio transmitters), or the use of lobby hall call buttons distinct from down hall call buttons, so that specific lobby calls are registered as distinct from non-lobby down calls.

According to the present invention, one or more elevators which serve a plurality of floors at the high end of a building, (referred to herein as a high rise) do not have hoistway structure below a certain floor, thereby not providing an express zone extending the service downwardly to one or more lobby floors. In further accord with the invention, only elevators capable of carrying passengers to the lobby floors are responsive to such calls. In accordance with the invention, up hall calls and non-lobby down hall calls registered in the high rise may preferentially be assigned to the high-only elevators.

The present invention saves considerable building space which may be used for utility rooms, service rooms, machine rooms and the like, or which comprise part of the rental space of the building, which in any case increases the portion of the building available for rental income, stairwells or other productive use. The invention improves allocation of down hall calls.

Other objects, features and advantages of the present invention will become more apparent in the light of the following detailed description of exemplary embodiments thereof, as illustrated in the accompanying drawing.

BEST MODE FOR CARRYING OUT THE INVENTION

Figure 1:
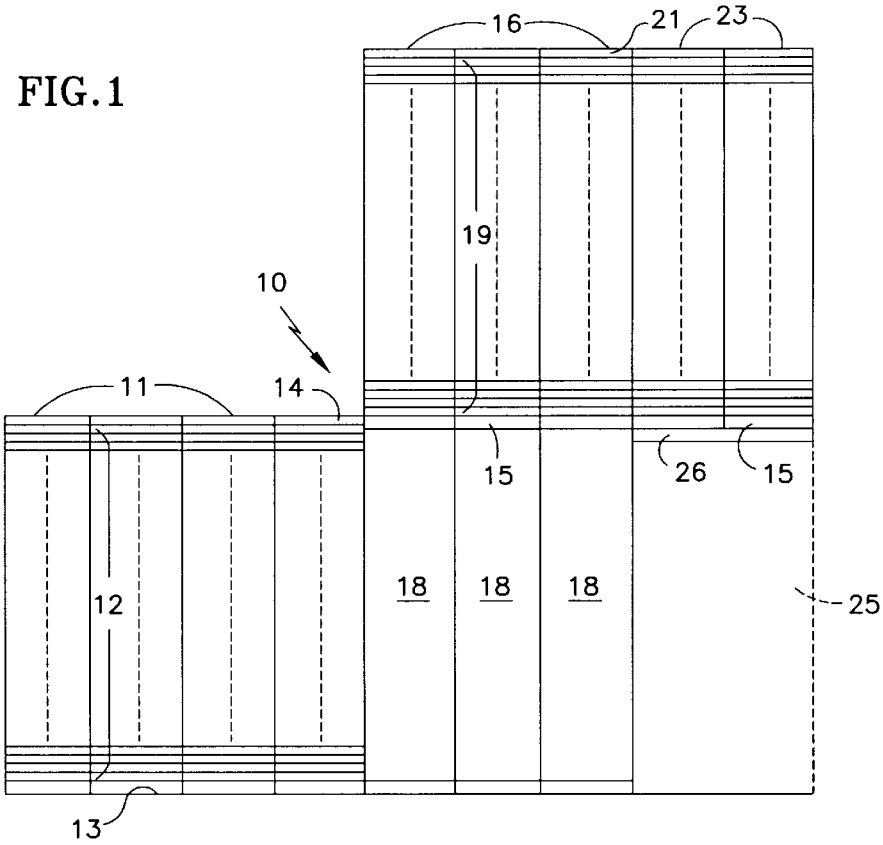
FIG. 1 is a stylized, schematic illustration of an elevator system employing the present invention.

Referring now to FIG. 1, an exemplary elevator system 10 may include a plurality of low rise elevators 11 which provide service to a plurality of floors 12 between a lobby floor 13 and a highest low rise floor 14, which may be the same as (as shown) or different than a lowest high rise floor 15. A plurality of high rise elevators provide express service through express zones 18 between the lobby floor 13 and the lowest high rise floor 15, as well as serving a plurality of floors 19 between the lowest high rise floor 15 and the highest high rise floor 23. In accordance with the invention, a pair of high-only elevators 23 provide service among the floors 19, the lowest high rise floor 15, and the highest high rise floor 21.

The high rise floor 21 may or may not be the highest floor in the building. The lobby floor 13 in the invention may be at or near ground level, or it may be a sky lobby served by shuttles that extend to the ground level. And, instead of a single lobby floor 13, there may be several lobby levels, without changing the purview of the present invention. Except for supporting structure on one or more floors 26, the space 25 beneath the elevators 23 does not have any hoistway or other elevator apparatus therein. The space 25 is therefore available for the production of income or other productive uses.

Figure 2:
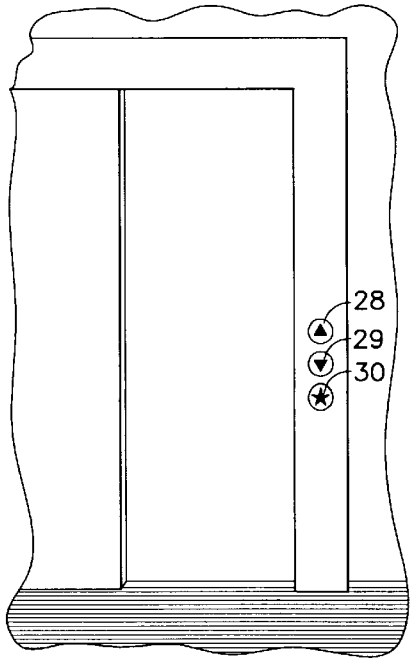
FIG. 2 is a fragmentary side elevation view of an elevator hatchway with call buttons which may be used with the present invention.
Figure 3:
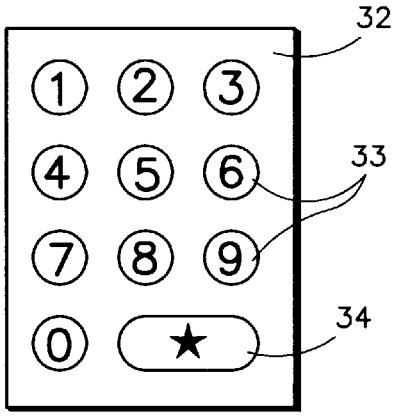
FIG. 3 is a side elevation view of a destination call button panel which may be utilized with the present invention.

Whenever a hall call is placed on any of the floors 15, 19, 21, the call may be for up service, down service, or service to the lobby, in the example herein. If a request for service to the lobby is made, only the elevators 16 can provide such service, the elevators 23 not having an express zone to extend to the lobby floor. In order to properly allocate hall calls, it is necessary to distinguish between lobby calls and down calls to other than the lobby. If a down call is registered, following which a lobby call is registered before the down call is served, the two calls are treated as a lobby call. In the most traditional sort of an elevator system, in which all hall calls are simply placed for either the up direction or the down direction, as illustrated by call buttons 28, 29 in FIG. 2, an additional button 30 referring to the lobby may be provided on all of the floors 19–21. On the floor 15, a choice can be made to provide either only the lobby button 30 or only the down button 29 since the only down call possible is to the lobby. In this embodiment, it is assumed that the only downward call button on floor 1 5 within the elevator rises serving the high rise elevators 16, 23 will be a lobby call button 30. Distinguishing between lobby calls and down calls for other than the lobby can also be provided by destination call systems, one example of which is shown in FIG. 3. Therein, a ten-key call button panel 32, similar to that used on TV remote controls and in some conventional elevator systems, allows entry of a call for any floor served by the pressing of two numerical buttons 33, or by pressing a lobby button 34. The numerical buttons can be used for up calls as well as down calls, as is conventional. Other ways in which a distinction can be made between lobby calls and down calls for other than the lobby is with remote call entry devices which typically use infrared or radio waves to automatically enter a call for an approaching passenger. These systems may either enter a call for a particular floor number, or may enter a call for a functional floor, such as cafeteria, lobby, or the like.

Figure 4:
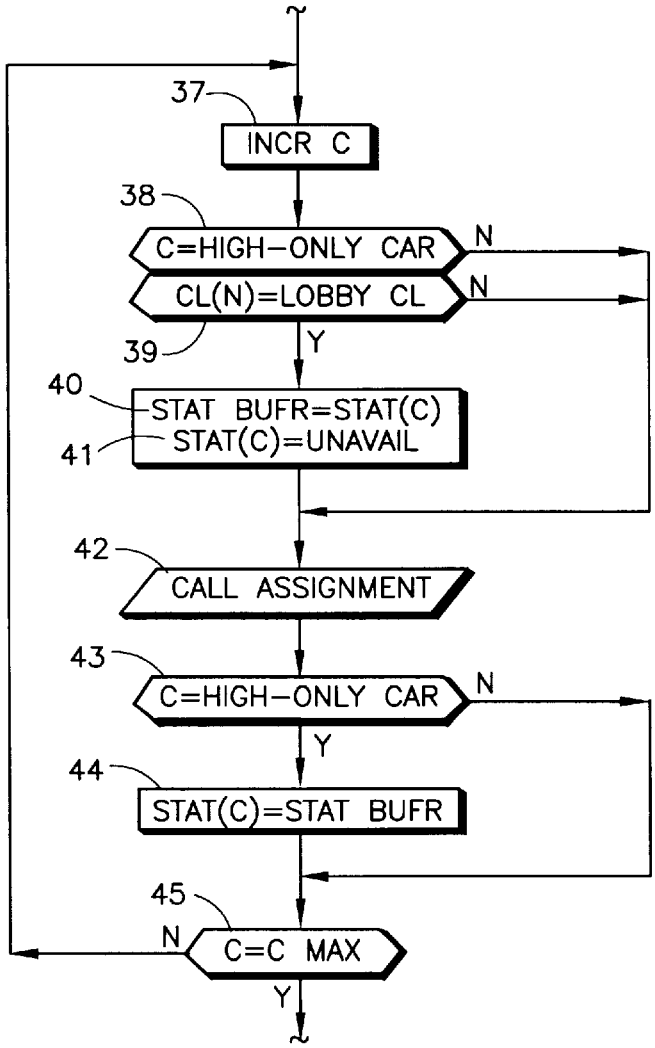
FIG. 4 is a fragmentary logic flow diagram of modifications which may be made to conventional hall call dispatching algorithms to accommodate the present invention.

The most essential feature of a dispatching controller for use with the system of the present invention is one which will allocate lobby calls from the high rise floors only to those elevators 16 which have an express zone extending to the lobby floor. One manner in which this may easily be achieved is, as each car is being considered in turn for the appropriateness of its assignment to a down call, preliminary steps are taken to eliminate cars in the elevators 23 from consideration. An example is illustrated in a fragment of a subroutine in FIG. 4. Therein, at the commencement of consideration of car C, resulting from incrementing a car counter, C, in a step 37, a test 38 first determines whether car C is a high-only car. If it is, then it is determined whether the call currently being assigned is a lobby call in a test 39. If both conditions exist, then a step 40 will retain the available/unavailable status of car C (for purposes described hereinafter) and the status of car C is made to be unavailable in a step 41. After that, a subroutine 42 will perform the call assignment in any suitable conventional way. But if the car under consideration is not one of the high-only cars 23, or if the call being assigned is not a lobby call, then the steps 40, 41 are bypassed. Following call assignment, if a test 43 determines that C is a high-only car (the same as test 38) then a step 44 will restore the status of car C to that indicated in the status buffer (available or unavailable as the case may have been before). Following that, a determination is made as to whether all cars have been considered, in the conventional way, in a test 45. If not, the routine will revert to the step 37 and provide the same functions to the next car in turn.

Other features of dispatching which may be implemented with the present invention include the provision of preference for up calls and non-lobby down calls to be assigned to the high-only cars 23. Instead of making the high-only cars 23 unavailable during assignment of a lobby call, a very high penalty for the assignment of lobby calls to high-only cars 23 may be utilized in any conventional system having weighted penalties to balance the various dispatching factors. Thus, all that is required for the invention is discriminating between lobby calls and down calls not for the lobby, and assigning lobby calls only to those elevators capable of serving them. The manner of doing it is irrelevant in the utilization of the invention.

The invention may be practiced with more than the high-only cars dedicated to non-lobby calls by giving the dispatching controller the ability to designate any one or more of the high rise elevators a temporary high-only elevator. The temporary designation would operate the same, in FIG. 4 for instance, in preventing assignment of lobby calls as does the permanent nature of the high-only cars.

If desired, the lobby-only and non-lobby down call buttons may be used on any or all floors of the building (even in the low rise elevators 11) to provide improved hall call allocation. Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. An elevator system comprising:

at least one high-only elevator hoistway having an elevator car providing service only between the lowest floor and the highest floor of a plurality of floors comprising a high rise and floors between said lowest and highest floors; and at least one high rise elevator hoistway having an elevator car providing elevator service between said plurality of floors, as well as providing express elevator service between a lobby floor and the lowest floor of said high rise;

a hall call request entry system for entering down hall call requests for service in the down direction other than to the lobby, and for entering lobby hall call requests for service to the lobby distinct from said down hall call requests; and a dispatching controller for assigning hall call requests for service to said elevators selectively, said dispatching controller assigning said lobby call requests for service only to said high rise elevators.

2. A system according to claim 1 wherein:

said dispatching controller assigns said down hall call requests for service other than to the lobby to any of said high rise elevators and said high-only elevators.

3. An elevator system according to claim 1 wherein:

said dispatching controller preferentially assigns hall calls other than said lobby hall call requests for service to said at least one high-only elevators.

4. An elevator system according to claim 1 wherein:

said dispatching controller designates any one or more of said high-rise elevator cars as a high-only elevator car, whereby lobby calls are not assigned to any said one elevator car when so designated.

5. An elevator system according to claim 1 wherein:

said dispatching controller assigns down hall call requests for service registered on a given floor simultaneously with lobby hall call requests for service registered on said given floor only to said high rise elevators.

6. An elevator system comprising:

a plurality of high rise elevator hoistways each having an elevator car providing express elevator service between a lobby floor and the lowest floor of a high rise, as well as elevator service between said lowest floor of the high rise and the highest floor of the high rise and floors between said lowest and highest floors;

at least one high-only elevator hoistway having an elevator car providing service only between the lowest floor of the high rise and the highest floor of the high rise and floors between said lowest and highest floors;

a hall call request entry system for entering down hall call requests for service in the down direction other than to the lobby, and for entering lobby hall call requests for service to the lobby distinct from said down hall call requests; and a dispatching controller for assigning down hall call requests for service to any of said high rise elevators and said high-only elevators, and for assigning said lobby hall call requests for service only to said high rise elevators.

* * * * *